US008367162B2

(12) United States Patent
Zhang et al.

(10) Patent No.: US 8,367,162 B2
(45) Date of Patent: Feb. 5, 2013

(54) PRETREATMENT METHOD FOR IMPROVING ANTIOXIDATION OF STEEL T91/P91 IN HIGH TEMPERATURE WATER VAPOR

(75) Inventors: Duqing Zhang, JiNan (CN); Guangming Liu, JiNan (CN); Guangcheng Zhang, JiNan (CN)

(73) Assignees: Shandong Electric Power Research Institute, Jinan (CN); State Grid Corporation of China, Beijing (CN)

( * ) Notice: Subject to any disclaimer, the term of this patent is extended or adjusted under 35 U.S.C. 154(b) by 0 days.

(21) Appl. No.: 13/375,654

(22) PCT Filed: Feb. 17, 2011

(86) PCT No.: PCT/CN2011/000243

§ 371 (c)(1), (2), (4) Date: Dec. 1, 2011

(87) PCT Pub. No.: WO2011/106988

PCT Pub. Date: Sep. 9, 2011

(65) Prior Publication Data

US 2012/0070574 A1 Mar. 22, 2012

(30) Foreign Application Priority Data

Feb. 22, 2010 (CN) ..... 2010 1 0111385

(51) Int. Cl.
*B05D 3/02* (2006.01)

(52) U.S. Cl. ..... 427/380

(58) Field of Classification Search ..... 427/380
See application file for complete search history.

(56) References Cited

U.S. PATENT DOCUMENTS 3,535,146 A * 10/1970 Flicker ..... 428/557
3,959,028 A * 5/1976 Jackson ..... 419/19
4,172,734 A * 10/1979 Takahashi et al. ..... 106/1.12
4,749,550 A * 6/1988 Goldie et al. ..... 422/19

(Continued)

FOREIGN PATENT DOCUMENTS

CN 1867699 A 11/2006
CN 101775599 A 7/2010
EP 0 459 637 B1 12/1994

OTHER PUBLICATIONS

Gao et al.; "Rare Earth Slurry Aluminizing Method and Performance;" *Mechanical Engineer*; 1999; pp. 55-56; No. 9.

(Continued)

*Primary Examiner* — Nathan Empie
(74) *Attorney, Agent, or Firm* — Oliff & Berridge, PLC

(57) ABSTRACT

Disclosed is a pretreatment method for improving antioxidation of steel T91/P91 in high temperature water vapor, which includes applying a slurry, containing rare earth oxide, on a surface of a substrate; holding the temperature in a gas mixture environment of inert gas and water vapor after drying; and cleaning away the solid powder left by the slurry on the surface, thereby obtaining the substrate with a surface rich in chromium and having a small amount of rare earth oxide. As a result of the method, the antioxidation capability of steel T91/P91 in the 500-750° C. water vapor environment can be improved, and films rich in chromium oxide can be formed on the surface of steel T91/P91.

9 Claims, 1 Drawing Sheet

U.S. PATENT DOCUMENTS

| | | | | |
|---|---|---|---|---|
| 5,288,345 | A * | 2/1994 | Ohhashi et al. | 148/514 |
| 2006/0166014 | A1* | 7/2006 | Klotz et al. | 428/469 |
| 2006/0261311 | A1* | 11/2006 | Poulet et al. | 252/387 |
| 2007/0065675 | A1 | 3/2007 | Stamm | |
| 2007/0149682 | A1* | 6/2007 | Ragunathan | 524/442 |
| 2009/0297718 | A1 | 12/2009 | Sarrafi-Nour et al. | |

OTHER PUBLICATIONS

Sundararajan et al.; "High temperature corrosion of nonceria coated 9Cr-1Mo ferritic steel in air and steam;" *Surface & Coatings Technology*; 2006; pp. 2124-2130; vol. 201.

Li et al.; "Effect of $CeO_2$ Coating on Oxidation Behavior of Fe-Cr Alloy in Water Vapor;" *Corrosion of Science and Protection Technology*; May 2008; pp. 157-161; vol. 20, No. 3 (with Abstract).

International Search Report dated May 26, 2011 in International Application No. PCT/CN2011/000243 (with translation).

Written Opinion of the International Searching Authority dated May 26, 2011 in International Application No. PCT/CN2011/000243 (with partial translation).

* cited by examiner

PRETREATMENT METHOD FOR IMPROVING ANTIOXIDATION OF STEEL T91/P91 IN HIGH TEMPERATURE WATER VAPOR

BACKGROUND

1. Field of Invention

The present invention relates to a pretreatment method for the surface of steel T91/P91, especially to a pretreatment method for improving antioxidation of steel T91/P91 in high temperature (500-750° C.) water vapor.

2. Description of Related Art

Currently, due to the excellent performance, the series ferritic steel containing 9-12% of Cr is applied to large-diameter P91 vapor pipes (main vapor pipes and reheat vapor pipes) and small-diameter T91 vapor pipes (superheater pipes and reheater pipes), which are used for thermal power generation. Compared with the conventional ferritic steel, such material has a better mechanical property and thus can be applied at a higher temperature and pressure, thereby improving the efficiency of thermal power generation. Currently, steel T91/P91 has become a common material used in the supercritical units of a power station boiler, due to relatively high tensile strength, high temperature creep and endurance strength, low thermal expansibility, excellent thermal conductivity, malleability and antioxidation capability, as well as high tenacity. However, the steel T91/P91 may still be seriously oxidized in high temperature and high pressure water vapor after being oxidized for a long time or when operating at a higher temperature.

In a water vapor atmosphere, at 500-750° C., the oxidation speed of the steel T91/P91 greatly increases as the temperature rises. The oxidation product of the steel T91/P91 comprises $Fe_2O_3$, $Fe_3O_4$ and $(Fe,Cr)_3O_4$. Since such material contains low content of Cr, no continuous or compact $Cr_2O_3$ layer is formed in oxide films generated at different temperatures, and even no $Cr_2O_3$ phase is formed in the oxide films. In general, the oxidation product is in a form of $(Fe,Cr)_3O_4$ solid solution. As the oxidation speed increases and the temperature changes, a thicker oxide film is subjected to larger growth stress and thermal stress, so the plastic deformation of the oxide film is limited. Thus, obvious oxide film stripping occurs in application of such materials, and in turn the oxide film stripping further increases the oxidation speed.

When the steel T91 and steel P91 are applied to a vapor pipe for thermal power generation, applying a coating on the inner wall or modifying the surface is one of efficient ways for improving the antioxidation of the steel T91 and steel P91 in the high temperature water vapor. However, the process for applying a coating/plating layer in a small-diameter vapor pipe is generally complicated, and in a simpler hot-dip aluminum plating process, due to the brittle phase of a Fe—Al intermetallic compound generated in the process, the plating layer is stripped during oxidation, and meanwhile, the mechanical property of the pipe is greatly influenced.

T. Sundararajan [T. Sundararajan, et al: Surface and Coatings Technology, 2006, 201, 2124.] detected the oxidation behavior of a sample in water vapor at 650° C. directly after nano-$CeO_2$ was coated on the surface of steel T91. The result indicates that the oxidation speed is lower than that of a blank sample. However, after being oxidized for 500 hours, the external layer of the oxide film is a ferric oxide, and the inner layer is a film composed of mixed oxides of Fe, Cr, and Si, whose antioxidation capability in water vapor is still limited.

Li Xingeng and Wang Xuegang [Li Xingeng, Wang Xuegang, et al: Corrosion Science and Protection Technology, 2008, 20(3) 157-161.] researched the oxidation behavior of a $CeO_2$ film deposited on the surface a Fe—Cr alloy containing 9% of Cr in the water vapor at 600-770° C. The result indicates that the deposited rare earth thin film neither changes the structure of the oxide film nor obviously reduces the oxidation speed.

SUMMARY

The present invention aims to overcome the shortcomings of the prior art and provides a pretreatment method for improving antioxidation of steel T91/P91 in high temperature water vapor. The method has the advantages that the process is simple, the cost is low, the practicability is strong, the service life is long, the antioxidation capability in high temperature water vapor is excellent, an oxide film rich in chromium oxide can be formed on the surface of steel T91/P91, etc.

To achieve the purpose mentioned above, the following technical scheme is adopted in the present invention:

A pretreatment method for improving antioxidation of steel T91/P91 in high temperature water vapor includes the following steps:

1) preparing a slurry: adding 0.5-35 wt % of aluminum powder and 65-99.5 wt % of rare earth oxide into a sodium silicate aqueous solution with modulus of 2.4-2.9 and density of 1.1-1.5 g/cm$^3$, and then stirring evenly to prepare the slurry;

2) coating the slurry prepared in step 1) on the surface of steel T91/P91;

3) drying: drying the steel T91/P91 coated in step 2) in an oven at 10-30° C. for 1-4 hours, and then drying at 70-100° C. for 1-4 hours;

4) carrying out heat preservation on the steel T91/P91 dried in step 3) in an atmosphere furnace charged with a gas mixture of inert gas and water vapor at the temperature of 600-800° C. for 24-48 hours; and then powering off the atmosphere furnace and naturally cooling the steel T91/P91 to room temperature in the furnace;

5) cleaning away the powder attached to the surface of the steel T91/P91 to obtain the steel T91/P91 with a surface containing chromium and rare earth oxide.

In preparation of the slurry in steps 1) and 2), the ratio of the sodium silicate aqueous solution to solid components composed of aluminum powder and rare earth oxide is 10-60 ml sodium silicate aqueous solution per 100 g solid components.

The rare earth oxide has purity equal to or larger than 99.00% and granularity equal to or less than 30 μm; and the aluminum powder has purity equal to or larger than 99.00% and granularity equal to or less than 0.4 mm.

The rare earth oxide is $Y_2O_3$ or $La_2O_3$.

In step 2), the slurry is coated in a manual brush coating or dip coating manner, or the slurry is naturally attached to the inner wall of a T91/P91 steel pipe after being injected into the steel pipe.

In step 4), the gas mixture of inert gas and water vapor comprises 60-95 vol % of inert gas and 5-40 vol % of water vapor.

The inert gas is argon with purity equal to or larger than 99.99% or helium with purity equal to or larger than 99.99%.

In step 5), the powder attached to the surface of steel T91/P91 is cleaned away by washing with distilled water.

The steel T91/P91 is used in an environment at a temperature of 500-750° C. with 5-40 vol % of water vapor.

The present invention has the following advantages:

1. The pretreated steel T91/P91 in the present invention has excellent antioxidation capability in high temperature water vapor, which can greatly reduce the oxidation speed of such materials in a water vapor atmosphere. After isothermally oxidized in the 700° C. water vapor environment for 600 hours, a blank sample has an oxidation mass gain of 16.51 $mg/cm^2$, while the surface-modified sample only has an oxidation mass gain of 0.15 $mg/cm^2$. The oxidation mass gain of the surface-modified sample is less than 1/100 of that of the blank sample, and meanwhile, no surface cracking or oxide-film stripping is found on the surface of the surface-modified sample.

2. In the present invention, the steel T91/P91 is treated with a rare earth containing mixture and then treated with a gas mixture of high temperature water vapor and inert gas to obtain a surface rich in chromium and having a small amount of rare earth oxide. The preparation process is simple, needs no vacuum conditions and has low cost.

3. After the sample is pretreated, the solid powder left on the surface is cleaned away by washing with distilled water, and the surface treatment does not change the surface roughness of the sample.

4. By using the present invention, the inner wall of a small-diameter pipe can be treated and the method of the present invention has wide applications. By applying the present invention, the antioxidation capability of steel T91 and steel P91 in a high temperature water vapor environment can be improved.

5. The coating process of the present invention is simple, which can be performed in a manual brush coating or dip coating manner, or the slurry with an adjusted viscosity is naturally attached to the inner wall of a T91/P91 steel pipe after being injected into the steel pipe.

DETAILED DESCRIPTION

Figure 1:
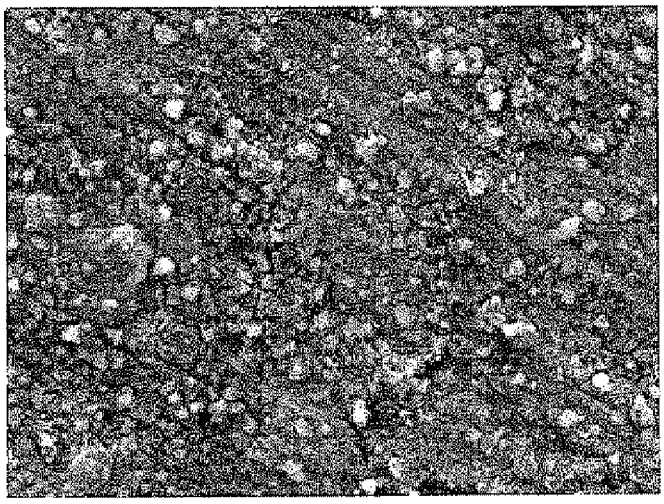
FIG. 1 illustrates the surface topography of steel T91 treated with a rare earth containing mixture according to the present invention.

The present invention is further described below with reference to the accompanying drawings and embodiments.

Embodiment 1: the solid powder mixture is composed of: yttrium oxide ($Y_2O_3$) with purity equal to or larger than 99.00% and granularity equal to or less than 30 μm; and aluminum powder with purity equal to or larger than 99.00% and granularity equal to or less than 0.4 mm.

The slurry is prepared by firstly adding 100 g solid powder mixture of 99.5 wt % of $Y_2O_3$ powder and 0.5 wt % of aluminum powder into 30 ml sodium silicate aqueous solution with modulus of 2.4-2.9 and density of 1.1 $g/cm^3$, and then stirring evenly to prepare the slurry.

The detailed data of this embodiment is as follows: the dimension of a T91 steel sample is 10×15×3 mm; and the slurry prepared through the abovementioned method is applied to the surface of the T91 steel sample in a dip coating manner, and then after dried in an oven at 30° C. for 2 hours, the T91 steel sample is dried in the oven at 100° C. for 1 hour. The dried steel T91 is put into an atmosphere furnace charged with a gas mixture of 90 vol % of argon (the purity is equal to or larger than 99.99%) and 10 vol % of water vapor mixture at a heating temperature of 720° C. for 48 hours; thereafter, the atmosphere furnace is powered off and the steel T91 is naturally cooled to room temperature in the furnace. The sample is taken out after cooled to room temperature in the furnace and is washed with distilled water to clean away the solid powder on the surface, thereby obtaining a surface rich in chromium and having a small amount of rare earth oxide.

The steel T91 is used in an environment at a temperature of 500° C. with 5 vol % of water vapor.

Figure 2:
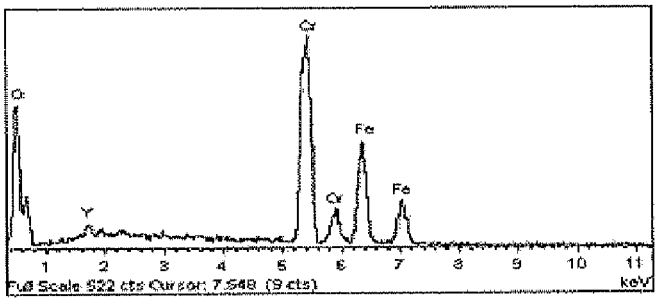
FIG. 2 illustrates an energy dispersion spectroscopy (EDS) of the steel T91 treated with a rare earth containing mixture according to the present invention.
Figure 3:
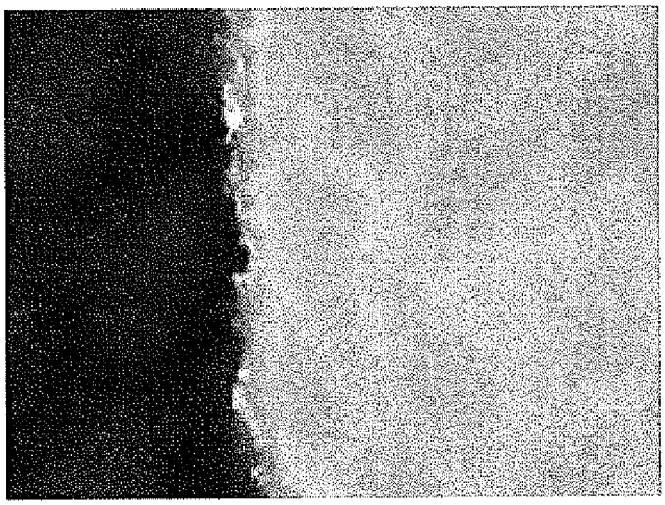
FIG. 3 illustrates the cross-section topography of the steel T91 pretreated and oxidized in water vapor at 700° C. for 600 hours according to the present invention.

FIG. 1 illustrates the surface topography and EDS of the steel T91 treated by the abovementioned process. The surface of the treated sample is rich in chromium and has a small amount of Y. After the pretreatment, the polishing scratches on the surface of the sample can be still observed through a scanning electron microscope (SEM), which indicates that the treatment does not change the surface roughness of the sample, and the surface of the treated sample is slightly shrimp pink. After the pretreatment, the sample is isothermally oxidized in a 700° C. water vapor environment for 600 hours, and finally only has an oxidation mass gain of 0.15 $mg/cm^2$. The surface of the sample is basically not obviously oxidized, with no oxide film stripping on the surface, and thus the antistrip performance of the sample is greatly improved, as shown in FIG. 3. A complete and continuous oxide film rich in chromium oxide and having an excellent binding force is formed through an oxidation process, and the oxide film has a thickness of about 1 μm, as shown in FIG. 2.

Embodiment 2: the solid powder mixture is composed of: yttrium oxide ($Y_2O_3$) with purity equal to or larger than 99.00% and granularity equal to or less than 30 μm; and aluminum powder with purity equal to or larger than 99.00% and granularity equal to or less than 0.4 mm.

The slurry is prepared by firstly adding 100 g solid powder mixture of 85 wt % of $Y_2O_3$ powder and 15 wt % of aluminum powder into 10 ml sodium silicate aqueous solution with modulus of 2.6 and density of 1.3 $g/cm^3$, and then stirring evenly to prepare the slurry.

The detailed data of this embodiment is as follows: the dimension of a P91 steel sample is 10×15×3 mm; and the slurry prepared through the abovementioned method is coated on the surface of the P91 steel sample in a dip coating manner, and then after dried in an oven at 10° C. for 4 hours, the P91 steel sample is dried in the oven at 70° C. for 4 hours. The dried steel P91 is put into an atmosphere furnace charged with a gas mixture of 95 vol % of argon (the purity is equal to or larger than 99.99%) and 5 vol % of water vapor at a heating temperature of 600° C. for 45 hours; thereafter, the atmosphere furnace is powered off and the steel P91 is naturally cooled to room temperature in the furnace. The sample is taken out after cooled to room temperature in the furnace and is washed with distilled water to clean away the solid powder on the surface, thereby obtaining a surface rich in chromium and having a small amount of rare earth oxide.

The steel P91 is used in an environment at a temperature of 600° C. with 25 vol % of water vapor.

Embodiment 3: the solid powder mixture is composed of: yttrium oxide ($Y_2O_3$) with purity equal to or larger than 99.00% and granularity equal to or less than 30 μm; and aluminum powder with purity equal to or larger than 99.00% and granularity equal to or less than 0.4 mm.

The slurry is prepared by firstly adding 100 g solid powder mixture of 65 wt % of $Y_2O_3$ powder and 35 wt % of aluminum powder into 60 ml sodium silicate aqueous solution with modulus of 2.9 and density of 1.5 $g/cm^3$, and then stirring evenly to prepare the slurry.

The detailed data of this embodiment is as follows: for a sample of a T91 steel pipe, the slurry is naturally attached to the inner wall of the T91 steel pipe after being injected into the steel pipe. After dried in an oven at 20° C. for 1 hour, the T91 steel pipe is dried in the oven at 85° C. for 2.5 hours. The dried steel T91 is put into an atmosphere furnace charged with a gas mixture of 60 vol % of helium (the purity is equal to or larger than 99.99%) and 40 vol % of water vapor at a heating temperature of 800° C. for 24 hours; thereafter, the atmosphere furnace is powered off and the steel T91 is naturally cooled to room temperature in the furnace. The sample is taken out after cooled to room temperature in the furnace and is washed with distilled water to clean away the solid powder on the surface, thereby obtaining a surface rich in chromium and having a small amount of rare earth oxide.

The steel T91 is used in an environment at a temperature of 750° C. with 40 vol % of water vapor.

Embodiment 4: the solid powder mixture is composed of: yttrium oxide ($Y_2O_3$) with purity equal to or larger than 99.00% and granularity equal to or less than 30 μm; and aluminum powder with purity equal to or larger than 99.00% and granularity equal to or less than 0.4 mm.

The slurry is prepared by firstly adding 100 g solid powder mixture of 70 wt % of $Y_2O_3$ powder and 30 wt % of aluminum powder into 20 ml sodium silicate aqueous solution with modulus of 2.8 and density of 1.2 g/cm$^3$, and then stirring evenly to prepare the slurry.

The detailed data of this embodiment is as follows: the dimension of a P91 steel sample is 10×15×3 mm; and the slurry prepared through the abovementioned method is coated on the surface of the P91 steel sample in a manual brush coating manner, and then after dried in an oven at 25° C. for 3 hours, the P91 steel sample is dried in the oven at 90° C. for 2 hours. The dried steel P91 is put into an atmosphere furnace charged with a gas mixture of 85 vol % of argon (the purity is equal to or larger than 99.99%) and 15 vol % of water vapor at a heating temperature of 780° C. for 30 hours; thereafter, the atmosphere furnace is powered off and the steel P91 is naturally cooled to room temperature in the furnace. The sample is taken out after cooled to room temperature in the furnace and is washed with distilled water to clean away the solid powder on the surface, thereby obtaining a surface rich in chromium and having a small amount of rare earth oxide.

The steel P91 is used in an environment at a temperature of 600° C. with 25 vol % of water vapor.

Embodiment 5: the solid powder mixture is composed of: lanthanum oxide ($La_2O_3$) with purity equal to or larger than 99.00% and granularity equal to or less than 30 μm; and aluminum powder with purity equal to or larger than 99.00% and granularity equal to or less than 0.4 mm.

The slurry is prepared by firstly adding 100 g solid powder mixture of 99 wt % of $La_2O_3$ powder and 1 wt % of aluminum powder into 50 ml sodium silicate aqueous solution with modulus of 2.6 and density of 1.3 g/cm$^3$, and then stirring evenly to prepare the slurry.

The detailed data of this embodiment is as follows: the dimension of a T91 steel sample is 10×15×3 mm; and the slurry prepared through the abovementioned method is coated on the surface of the T91 steel sample in a manual brush coating manner, and then after dried in an oven at 30° C. for 1 hour, the T91 steel sample is dried in the oven at 100° C. for 2 hours. The dried steel T91 is put into an atmosphere furnace charged with a gas mixture of 95 vol % of argon (the purity is equal to or larger than 99.99%) and 5 vol % of water vapor at a heating temperature of 690° C. for 40 hours; thereafter, the atmosphere furnace is powered off and the steel T91 is naturally cooled to a room temperature in the furnace. The sample is taken out after cooled to the room temperature in the furnace and is washed with distilled water to clean away the solid powder on the surface, thereby obtaining a surface rich in chromium and having a small amount of rare earth oxide.

The steel T91 is used in an environment at a temperature of 500° C. with 5 vol % of water vapor.

Embodiment 6: the solid powder mixture is composed of: lanthanum oxide ($La_2O_3$) with purity equal to or larger than 99.00% and granularity equal to or less than 30 μm; and aluminum powder with purity equal to or larger than 99.00% and granularity equal to or less than 0.4 mm.

The slurry is prepared by firstly adding 100 g solid powder mixture of 99.5 wt % of $La_2O_3$ powder and 0.5 wt % of aluminum powder into 60 ml sodium silicate aqueous solution with modulus of 2.4 and density of 1.1 g/cm$^3$, and then stirring evenly to prepare the slurry.

The detailed data of this embodiment is as follows: the dimension of a P91 steel sample is 10×15×3 mm; and the slurry prepared through the abovementioned method is coated on the surface of the P91 steel sample in a dip coating manner, and then after dried in an oven at 10° C. for 4 hours, the P91 steel sample is dried in the oven at 70° C. for 4 hours. The dried steel P91 is put into an atmosphere furnace charged with a gas mixture of 80 vol % of helium (the purity is equal to or larger than 99.99%) and 20 vol % of water vapor at a heating temperature of 600° C. for 48 hours; thereafter, the atmosphere furnace is powered off and the steel P91 is naturally cooled to room temperature in the furnace. The sample is taken out after cooled to room temperature in the furnace and is washed with distilled water to clean away the solid powder on the surface, thereby obtaining a surface of the steel P91 rich in chromium and having a small amount of rare earth oxide.

The steel P91 is used in an environment at a temperature of 600° C. with 25 vol % of water vapor.

Embodiment 7: the solid powder mixture is composed of: lanthanum oxide ($La_2O_3$) with purity equal to or larger than 99.00% and granularity equal to or less than 30 μm; and aluminum powder with purity equal to or larger than 99.00% and granularity equal to or less than 0.4 mm.

The slurry is prepared by firstly adding 100 g solid powder mixture of 65 wt % of $La_2O_3$ powder and 35 wt % of aluminum powder into 10 ml sodium silicate aqueous solution with modulus of 2.9 and density of 1.5 g/cm$^3$, and then stirring evenly to prepare the slurry.

The detailed data of this embodiment is as follows: for a sample of a T91 steel pipe, the slurry is naturally attached to the inner wall of the T91 steel pipe after being injected into the steel pipe. After dried in an oven at 20° C. for 1 hour, the T91 steel pipe is dried in the oven at 85° C. for 2.5 hours. The dried T91 steel is put into an atmosphere furnace charged with a gas mixture of 60 vol % of helium (the purity is equal to or larger than 99.99%) and 40 vol % of water vapor at a heating temperature of 800° C. for 24 hours; thereafter, the atmosphere furnace is powered off and the steel T91 is naturally cooled to room temperature in the furnace. The sample is taken out after cooled to room temperature in the furnace and is washed with distilled water to clean away the solid powder on the surface, thereby obtaining a surface rich in chromium and having a small amount of rare earth oxide.

The steel T91 is used in an environment at a temperature of 750° C. with 40 vol % of water vapor.

Embodiment 8: the solid powder mixture is composed of: lanthanum oxide ($La_2O_3$) with purity equal to or larger than 99.00% and granularity equal to or less than 30 μm; and aluminum powder with purity equal to or larger than 99.00% and granularity equal to or less than 0.4 mm.

The slurry is prepared by firstly adding 100 g solid powder mixture of 75 wt % of $La_2O_3$ powder and 25 wt % of aluminum powder into 45 ml sodium silicate aqueous solution with modulus of 2.5 and density of 1.4 g/cm$^3$, and then stirring evenly to prepare the slurry.

The detailed data of this embodiment is as follows: the dimension of a T91 steel sample is 10×15×3 mm; and the slurry prepared through the abovementioned method is coated on the surface of the T91 steel sample in a manual brush coating manner, and then after dried in an oven at 25° C. for 3 hours, the T91 steel sample is dried in the oven at 90° C. for 3 hours. The dried T91 steel is put into an atmosphere furnace with a gas mixture of 78 vol % of argon (the purity is equal to or larger than 99.99%) and 22 vol % of water vapor at a heating temperature of 750° C. for 35 hours; thereafter, the atmosphere furnace is powered off and the steel T91 is naturally cooled to room temperature in the furnace. The sample is taken out after cooled to room temperature in the furnace and is washed with distilled water to clean away the solid powder on the surface, thereby obtaining a surface of the steel T91 rich in chromium and having a small amount of rare earth oxide.

The steel T91 steel is used in an environment at a temperature of 650° C. with 38 vol % of water vapor.

What is claimed is:

1. A pretreatment method for improving antioxidation of steel T91/P91 in high temperature water vapor, comprising:

1) preparing a slurry: adding a mixture of 0.5-35 wt % of aluminum powder and 65-99.5 wt % of rare earth oxide into a sodium silicate aqueous solution with modulus of 2.4-2.9 and density of 1.1-1.5 g/cm$^3$, and then stirring evenly to prepare the slurry, wherein the rare earth oxide is $Y_2O_3$ or $La_2O_3$;
2) coating the slurry prepared in step 1) on the surface of steel T91/P91;
3) drying: drying the steel T91/P91 coated in step 2) in an oven at 10-30° C. for 1-4 hours, and then drying at 70-100° C. for 1-4 hours;
4) carrying out heat preservation on the steel T91/P91 dried in step 3) in an atmosphere furnace charged with a gas mixture of inert gas and water vapor at the temperature of 600-800° C. for 24-48 hours; and then powering off the atmosphere furnace and naturally cooling the steel T91/P91 to room temperature in the furnace;
5) cleaning away the powder attached to the surface of the steel T91/P91 to obtain the steel T91/P91 with a surface containing chromium and rare earth oxide.

2. The pretreatment method for improving antioxidation of steel T91/P91 in high temperature water vapor according to claim 1, wherein in preparation of the slurry in steps 1) and 2), the ratio of the sodium silicate aqueous solution to solid components composed of aluminum powder and rare earth oxide is 10-60 ml sodium silicate aqueous solution per 100 g solid components.

3. The pretreatment method for improving antioxidation of steel T91/P91 in high temperature water vapor according to claim 2, wherein the rare earth oxide has purity equal to or larger than 99.00% and granularity equal to or less than 30 μm; and the aluminum powder has purity equal to or larger than 99.00% and granularity equal to or less than 0.4 mm.

4. The pretreatment method for improving antioxidation of steel T91/P91 in high temperature water vapor according to claim 1, wherein the rare earth oxide has purity equal to or larger than 99.00% and granularity equal to or less than 30 μm; and the aluminum powder has purity equal to or larger than 99.00% and granularity equal to or less than 0.4 mm.

5. The pretreatment method for improving antioxidation of steel T91/P91 in high temperature water vapor according to claim 1, wherein in step 2), the slurry is coated in a manual brush coating or dip coating manner, or the slurry is naturally attached to the inner wall of a T91/P91 steel pipe after being injected into the steel pipe.

6. The pretreatment method for improving antioxidation of steel T91/P91 in high temperature water vapor according to claim 1, wherein in step 4), the gas mixture of inert gas and water vapor comprises 60-95 vol % of inert gas and 5-40 vol % of water vapor.

7. The pretreatment method for improving antioxidation of steel T91/P91 in high temperature water vapor according to claim 6, wherein the inert gas is argon with purity equal to or larger than 99.99% or helium with purity equal to or larger than 99.99%.

8. The pretreatment method for improving antioxidation of steel T91/P91 in high temperature water vapor according to claim 1, wherein the inert gas is argon with purity equal to or larger than 99.99% or helium with purity equal to or larger than 99.99%.

9. The pretreatment method for improving antioxidation of steel T91/P91 in high temperature water vapor according to claim 1, wherein in step 5), the powder attached to the surface of the steel T91/P91 is cleaned away by washing with distilled water.

* * * * *